US005918978A

United States Patent [19]

Schieg

[11] Patent Number: 5,918,978

[45] Date of Patent: Jul. 6, 1999

[54] DEVICE FOR MIXING CHEMICALS INTO A FIBROUS MATERIAL SUSPENSION

[75] Inventor: Rudolf Schieg, Graz, Austria

[73] Assignee: Andritz-Patentverwaltungs-Gesellschaft m.b.H., Graz, Austria

[21] Appl. No.: 08/930,984

[22] PCT Filed: Mar. 27, 1996

[86] PCT No.: PCT/EP96/01345

§ 371 Date: Oct. 13, 1997

§ 102(e) Date: Oct. 13, 1997

[87] PCT Pub. No.: WO96/32186

PCT Pub. Date: Oct. 17, 1996

[30] Foreign Application Priority Data

Apr. 12, 1995 [AT] Austria ..... 632/95

[51] Int. Cl.[6] ..... B01F 7/32

[52] U.S. Cl. ..... 366/168.1; 366/300; 366/301; 162/261; 162/243

[58] Field of Search ..... 366/300, 301, 366/297, 155.1, 262, 325.6, 299, 168.1; 162/261, 243

[56] References Cited

U.S. PATENT DOCUMENTS

| | | | |
|---|---|---|---|
| 2,628,082 | 2/1953 | Fredenhagen et al. . | |
| 3,189,516 | 6/1965 | Duchange | 162/243 |
| 3,314,660 | 4/1967 | Arbiter . | |
| 3,640,509 | 2/1972 | Inamura et al. | 366/301 |
| 4,034,967 | 7/1977 | Gustairs | 366/301 |
| 4,760,717 | 8/1988 | Ponzielli | 162/243 |
| 4,776,703 | 10/1988 | Oda et al. | 366/301 |
| 4,804,439 | 2/1989 | Fredriksson | 366/301 |
| 5,411,330 | 5/1995 | Arutyunov et al. | 366/301 |

FOREIGN PATENT DOCUMENTS

| | | | |
|---|---|---|---|
| 222599 | 5/1987 | European Pat. Off. . | |
| 578284 | 1/1994 | European Pat. Off. . | |
| 1457331 | 2/1969 | Germany . | |
| 2029585 | 12/1971 | Germany . | |
| 1789261 | 1/1993 | U.S.S.R. | 366/301 |

*Primary Examiner*—Tony G. Soohoo
*Attorney, Agent, or Firm*—Alix, Yale & Ristas, LLP

[57] ABSTRACT

The invention refers to a device for mixing chemicals into a pulp suspension, where a high-speed rotor (5) with an open center is mounted inside a mixing chamber (2). It is mainly characterized by at least one further high-speed rotor (5') with open center being provided, the areas covered by these rotors (5, 5') overlapping and the spacing between the axis of the rotors (5, 5') being selected so that the rotor arms (8, 8') extend almost to the center of at least one other rotor (5, 5').

13 Claims, 3 Drawing Sheets

DEVICE FOR MIXING CHEMICALS INTO A FIBROUS MATERIAL SUSPENSION

CROSS-REFERENCE TO RELATED APPLICATIONS

This is the U.S. national stage of International Application No. PCT/EP96/01345 filed Mar. 27, 1996.

BACKGROUND OF THE INVENTION

1. Field of the Invention

The invention relates to a process for mixing chemicals into a pulp suspension, preferably in the medium-consistency range, where a rotor is mounted inside a mixing chamber.

2. Description of the Related Art

In addition to the static mixers and so-called high-shear mixers, mixers are also known which make use of the so-called fluidization principle. Such mixers are known, for example, from EP 0 578 284, U.S. Pat. No. 5,279,709 and WO 93/17782. In these mixers, the high-speed rotation of the agitators exerts high shearing stress on the pulp, which then dissolves the pulp mesh and gives the suspension the physical properties of water. Here, a high-speed rotor is mounted in a suitable casing. Due to the relatively large gap between the rotor and the housing, the drive power is much lower compared with high-shear mixers and the individual fibers in the suspension are not destroyed (shortened). Since the dimensions of the housing are small, relatively high throughput rates are achieved and the pulp retention times in the mixer are relatively short as a result. Thus, only brief periods are available for the fluidization process. Particularly when gaseous chemicals are mixed into the pulp, the liquid and the gas separate because of the difference in density. When this happens, the gas moves towards the center of the rotor and is removed there from the mixture of gas and liquid. This effect is exploited by pumps used to convey pulps, particularly in the medium-consistency range, in order to be able to extract the unwanted air at the center of the rotor. Furthermore, mixers are known from U.S. Pat. No. 3,314,660 which can mix different pulps well in one tank. In this case, mixing takes place in a batch process in which the pulps are fed into the tank and then mixed. What is required of a good mixer to mix gaseous chemicals continuously into a pulp suspension is, however, even distribution of the fine bubbles of gas in the pulp. For the reason mentioned above, the mixers known to date do not fulfill the necessary requirements pertaining to even distribution of the chemicals, e.g. ozone, mixed into the pulp.

SUMMARY OF THE INVENTION

The aim of the invention now is to guarantee that chemicals are mixed in evenly, particularly chemicals in gaseous form.

This is achieved by including at least one more rotor and the areas covered by each rotor overlapping. With this arrangement, the number of agitator rotations in the pulp can be doubled while the mixer is running at the same speed.

A further development of the invention is characterized by the center distance of the rotors being selected so that the rotor arms extend almost to the center of at least one other rotor. This design guarantees that the gas cannot escape at the center of a rotor when mixing in chemicals, particularly gaseous chemicals. Due to the rotating movement generated, the undesirable separation of gases at the center of the rotor is prevented, thus permitting even distribution of the chemicals in the pulp suspension.

An advantageous configuration of the invention is characterized by at least the one additional rotor rotating in the opposite direction. Very large shearing forces and turbulences are generated when the rotors rotate in opposite directions, which in turn allow the chemicals added to be mixed well into the pulp and finely distributed, as required.

A favorable further development of the invention is characterized by strips and/or ribs being mounted inside the housing. These exert very high shearing forces on the suspension and generate turbulences, which in turn allow the chemicals added to be mixed well into the pulp and finely distributed, as required.

A favorable configuration of the invention is characterized by the chemicals being mixed into the pulp in the turbulence zone at the mixer inlet area. Since the chemicals are fed directly into the turbulence zone, where fluidization generally takes place as well, mixing efficiency is further improved.

A favorable further development of the invention is characterized by the circumferential speed of the rotors being controlable and located particularly in the range between 20 and 30 m/sec. Since the circumferential speed of the rotors is controlable, it can be adapted to suit the given requirements, which are dictated mainly by the varying pulp properties. In order to achieve good fluidization, it is preferable to set rotor circumferential speeds of 20 to 30 m/sec.

A favorable configuration of the invention is characterized by the ends of the rotor arms being joined together at the bottom in a round or oval shape, i.e., a hollow loop, (closed design), with different shapes of cross-section. The rotor arms may also not be connected at the ends (open design) and have different shapes of cross-section. Since the rotor arms can take different forms, they can be adjusted to best suit the given requirements and adapted to the properties of both the pulp suspension and the chemicals to be mixed into the pulp.

A favorable further development of the invention is characterized by the mixer having a flow resistance between 0.2 and 0.6 bar. Due to the low flow resistance or pressure loss, the power requirement for the circulating pump which usually precedes the mixer is correspondingly low. This also means that the pulp can flow through the mixer unhindered, even if there is a breakdown (shutdown due to a fault).

BRIEF DESCRIPTION OF THE DRAWINGS

The invention will now be described in examples and referring to the drawings, where.

DESCRIPTION OF THE PREFERRED EMBODIMENT

Figure 1:
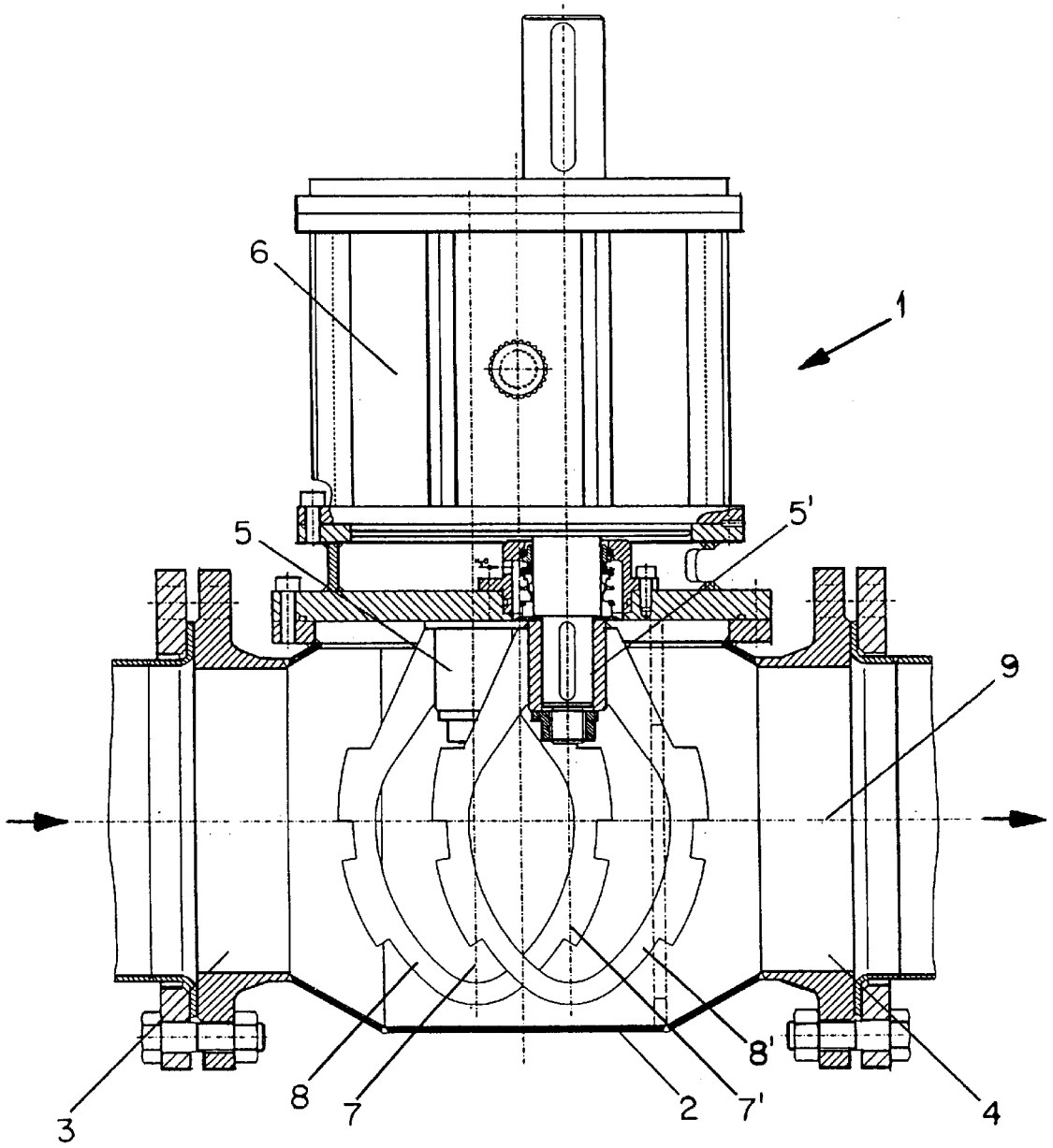
FIG. 1 shows an axial section through a mixer according to the invention, FIG. 2*a* contains a schematic view of an axial section through one variant of the invention.

FIG. 1 shows a mixer 1 with a mixer housing (or mixing chamber) 2, an inlet area 3, an outlet area 4 and rotors 5, 5'. As shown in FIG. 1, mixing chamber 2 is located in a pipe connected to inlet area 3 and outlet area 4. Also as shown in FIG. 1, pulp suspension flows into mixing chamber 2 in a downstream direction along axis 9. The rotors are connected to a drive (not shown) via a gearbox 6. The rotor axes 7, 7' and thus, also the rotors 5, 5' themselves are out of line with the longitudinal axis 9 of the mixer. This results in less space being required on the one hand and on the other, it ensures that the volume of pulp suspension is spread well round the mixer housing 2 by the rotor arms 8, 8'.

Figure 2A:
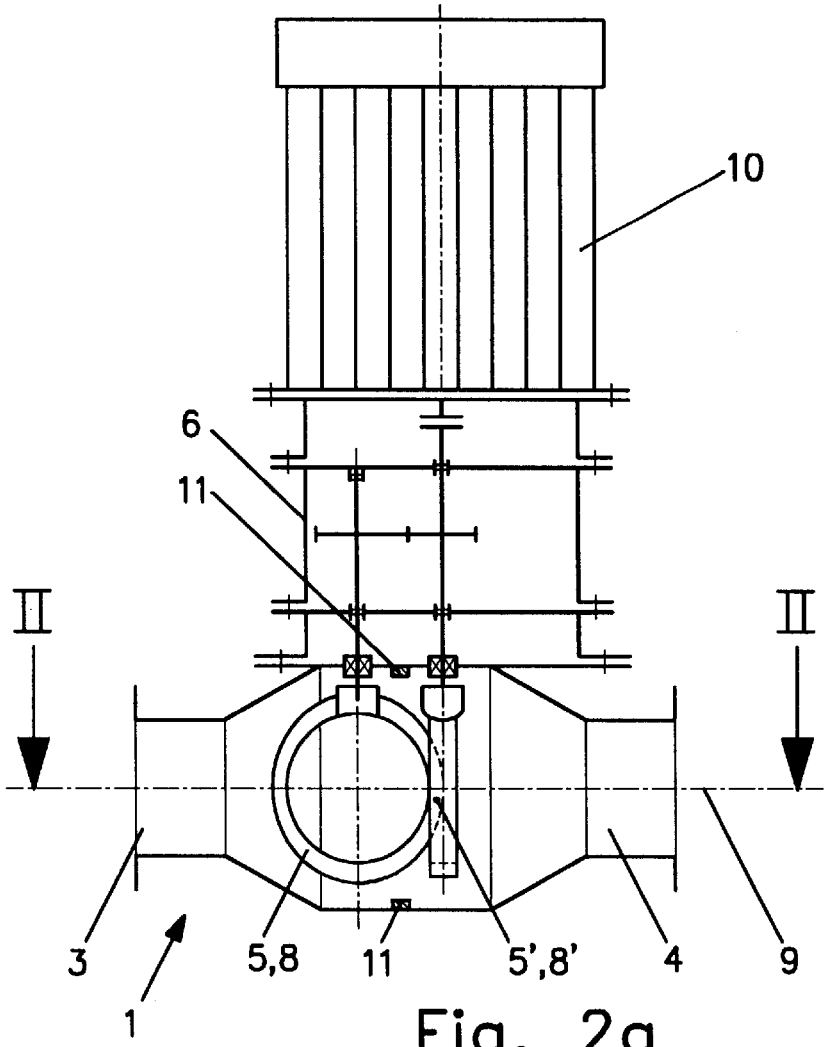
FIG. 2*b* shows a cross-section through the variant according to FIG. 2*a,* FIG. 3*a* contains an axial section through a further variant of the invention

FIG. 2*a* shows a further variant of the mixer according to the invention in which the same parts are marked with the same reference numerals. The gearbox 6 and the drive 10 which are also required here are shown in a diagrammatic view.

Figure 2B:
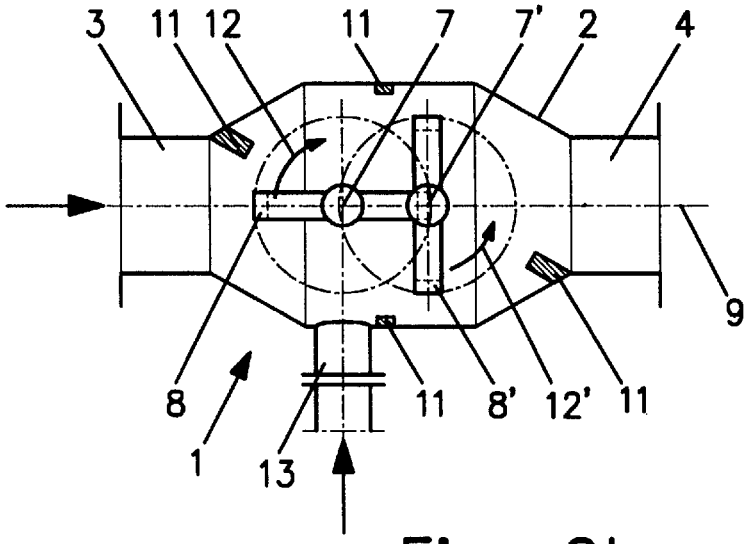

FIG. 2*b* shows a section through FIG. 2*a* at the line marked II—II. This shows that the rotor axes 7, 7' are located on axis 9 of the mixer 1. This illustration also shows the strips and/or ribs 11 mounted at various points in the mixer housing 2 and oriented either parallel to or perpendicular to rotor axes 7, 7'. The rotors 5, 5' rotate in opposite directions 12, 12' to define respective volumes of revolution which overlap one another and each one extends into the center of the other rotor, i.e., to the respective axis (7 or 7') of the other rotor. This is illustrated very clearly in FIG. 2*a*. In this case, the chemicals are fed into the housing 2 of the mixer 1 through a chemical feed port 13.

Figure 3A:
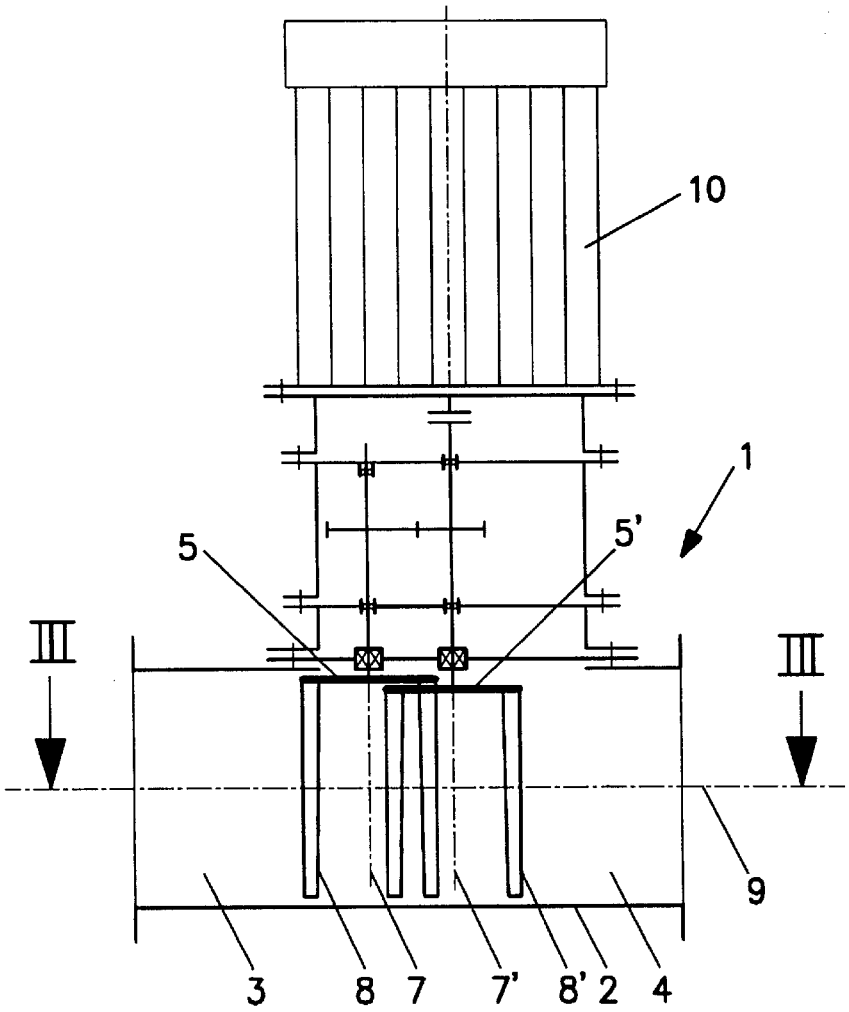
FIG. 3*b* shows an axial cross-section through the variant according to FIG. 3*a*.
Figure 3B:
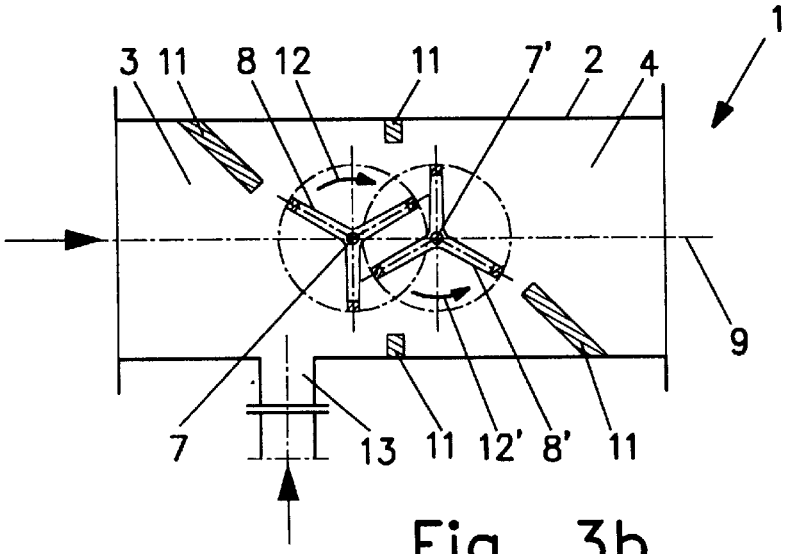

FIGS. 3*a* and 3*b* show a further variant of the mixer 1. The rotors 5, 5' are shown here with three arms, with rotor arms 8 and 8' not connected at the bottom ends. Here, too, the rotors rotate in opposite directions 12, 12' and the way in which the mixing ranges intermesh is clearly illustrated.

The variants illustrated are merely examples of the invention, where, for example, the rotors may also have a different number of arms or also be shaped differently. Similarly, the chemicals can also be added in the pipe before the pulp reaches the mixing chamber. The optimum feed point in each case can be selected depending on which chemicals are used, which chemicals may either be in liquid or gaseous form.

What is claimed is:

1. A mixer for mixing chemicals into a pulp suspension, said mixer comprising:

a mixing chamber having axially-aligned inlet and outlet areas which define a linear downstream direction;

a pipe connected to said inlet and outlet areas of said chamber such that pulp suspension fed into said pipe enters said chamber through said inlet area, exits said chamber from said outlet area and re-enters said pipe; and first and second rotors each having a rotor arm with an open center wherein said first and second rotors can be rotated about respective parallel axes each of which is at least substantially perpendicular to said linear downstream direction, said rotor arms being disposed within said mixing chamber such that rotation of each rotor arm defines a volume of revolution, such that said volumes of revolution overlap and such that said first and second rotors distribute the chemicals in the pulp suspension.

2. The mixer of claim 1, wherein said first rotor can be rotated in a first direction and said second rotor can be rotated in a direction opposite to said first direction.

3. The mixer of claim 1, wherein said mixer further comprises means for controlling the rotational speed of said rotor arms to rotate at a circumferential speed of between 20 and 30 m/sec.

4. The mixer of claim 1, wherein at least one of said rotor arms is joined at a bottom end thereof to thereby define a hollow loop.

5. The mixer of claim 1, wherein each of said rotor arms is joined at a bottom end thereof to thereby define a hollow loop.

6. The mixer of claim 1, wherein at least one of said rotor arms is not joined at a bottom end thereof.

7. The mixer of claim 1, wherein said rotor arms have different cross-sectional shapes.

8. The mixer of claim 1, wherein each of said rotors has at least two rotor arms.

9. A mixer for mixing chemicals into a pulp suspension, said mixer comprising:

a mixing chamber which has an inlet area and an outlet area;

ribs mounted within said mixing chamber;

a pipe connected to said inlet and outlet areas of said chamber such that pulp suspension fed into said pipe in a downstream direction enters said chamber through said inlet area, exits said chamber from said outlet area and re-enters said pipe; and first and second rotors each having a rotor arm with an open center wherein said first and second rotors can be rotated about respective parallel axes, said rotor arms being disposed within said mixing chamber such that rotation of each rotor arm defines a volume of revolution, such that said volumes of revolution overlap and such that said first and second rotors distribute the chemicals in the pulp suspension.

10. The mixer of claim 9, wherein said ribs are oriented at least one of perpendicular to or parallel to said parallel axes of said rotors.

11. A mixer for mixing gaseous chemicals into a pulp suspension, said mixer comprising:

a mixing chamber which has an inlet area and an outlet area;

a pipe connected to said inlet and outlet areas of said chamber such that pulp suspension fed into said pipe in a downstream direction enters said chamber through said inlet area, exits said chamber from said outlet area and re-enters said pipe;

means for feeding the gaseous chemicals into said pipe in a location which is not downstream of said mixing chamber; and first and second rotors each having a rotor arm with an open center wherein said first and second rotors can be rotated about respective parallel axes, said rotor arms being disposed within said mixing chamber such that rotation of each rotor arm defines a volume of revolution, such that said volumes of revolution overlap and such that said first and second rotors distribute the chemicals in the pulp suspension.

12. A mixer for mixing chemicals into a pulp suspension, said mixer comprising:

a mixing chamber which has an inlet area and an outlet area;

ribs mounted within said mixing chamber;

a pipe connected to said inlet and outlet areas of said chamber such that pulp suspension fed into said pipe in a downstream direction enters said chamber through said inlet area, exits said chamber from said outlet area and re-enters said pipe;

first and second rotors each having a rotor arm with an open center wherein said first and second rotors can be rotated about respective parallel axes, said rotor arms being disposed within said mixing chamber such that rotation of each rotor arm defines a volume of revolution, such that said volumes of revolution overlap and such that said first and second rotors distribute the chemicals in the pulp suspension; and means for feeding the chemicals into said inlet area of said mixing chamber.

13. A mixer for mixing chemicals into a pulp suspension, said mixer comprising:

a mixing chamber which has an inlet area and an outlet area;

a pipe connected to said inlet and outlet areas of said chamber such that pulp suspension fed into said pipe in a downstream direction enters said chamber through said inlet area, exits said chamber from said outlet area and re-enters said pipe; and first and second rotors each having a rotor arm with an open center wherein said first and second rotors can be rotated about respective parallel axes, said rotor arms being disposed within said mixing chamber such that rotation of said first rotor defines a volume of revolution which extends to said axis of said second rotor, such that rotation of said second rotor defines a volume of revolution which extends to said axis of said first rotor and such that rotation of said first and second rotors distribute the chemicals in the pulp suspension.

* * * * *